US007007803B2

(12) United States Patent
Richter

(10) Patent No.: US 7,007,803 B2
(45) Date of Patent: Mar. 7, 2006

(54) DEVICE FOR STORING LIQUIDS

(76) Inventor: Günter Richter, Johannistal 12, 57610 Altenkirchen (DE)

( * ) Notice: Subject to any disclaimer, the term of this patent is extended or adjusted under 35 U.S.C. 154(b) by 191 days.

(21) Appl. No.: 10/433,732

(22) PCT Filed: Mar. 15, 2002

(86) PCT No.: PCT/EP02/02911

§ 371 (c)(1),
(2), (4) Date: Jun. 3, 2003

(87) PCT Pub. No.: WO02/076837

PCT Pub. Date: Oct. 3, 2002

(65) Prior Publication Data

US 2004/0026356 A1 Feb. 12, 2004

(30) Foreign Application Priority Data

Mar. 22, 2001 (DE) ..... 101 14 130

(51) Int. Cl.
*B65D 79/00* (2006.01)

(52) U.S. Cl. ..... 206/527; 215/380

(58) Field of Classification Search ..... 206/527; 215/232, 380, 382, 385, 6, 383, 371; 220/500, 220/516, 23.8; D27/163
See application file for complete search history.

(56) References Cited

U.S. PATENT DOCUMENTS 1,737,744 A * 12/1929 Wicklein ..... 215/10
D327,639 S * 7/1992 Burnsed ..... D9/740
6,161,713 A * 12/2000 Krich ..... 215/384
6,655,541 B1 * 12/2003 Schultz ..... 220/560.1

FOREIGN PATENT DOCUMENTS

| | | |
|---|---|---|
| DE | 195 24 474 A1 | 1/1996 |
| DE | 198 18 709 A1 | 10/1999 |
| DE | 201 05 030 U1 | 8/2001 |
| FR | 2725963 | 4/1996 |

* cited by examiner

*Primary Examiner*—Shian T. Luong
(74) *Attorney, Agent, or Firm*—Friedrich Kueffner

(57) ABSTRACT

The invention relates to a device for storing liquids comprised of a plastic container, which is produced by a blowing process, which has a single layer or multilayer wall, and which is provided with at least one filling and emptying opening. The aim of the invention is, on the one hand, to economically manufacture a device of the aforementioned type by using inexpensive forming tools and, on the other hand, to be able to transport the device from the production site to the storing site also without incurring large expenditures. To this end, the container (1) is formed from at least two separately manufactured and largely identical container parts (2, 3), each of which comprising an approximately rectangular cross section with an underside (4) and a upper side (5) and having a height that is considerably greater than the largest cross section measure. Each of the container parts also have, on one side, a lower and an upper flow socket (10, 11), and are joined to one another in the area of these flow sockets (10,11) whereby forming one piece.

5 Claims, 4 Drawing Sheets

DEVICE FOR STORING LIQUIDS

BACKGROUND OF THE INVENTION

1. Field of the Invention

The invention concerns a device for storing liquids, which consists of a plastic container produced by a blowing process, has a single-layer or multilayer wall, and is provided with at least one filling and emptying hole.

2. Description of the Related Art

To hold liquids, especially rainwater and wastewater, devices are used, which consist of a plastic container, which is often installed underground or buried in the ground. Plastic containers of this type are produced mainly by rotational molding with the use of glass fibers or by blow molding. Mainly high-molecular-weight high-density polyethylene, which not only is inexpensive, but also can be easily processed and is highly durable, is used for containers produced by blow molding. However, blow-molded plastic containers are limited in their size. This is related to the fact that very large containers require large and thus expensive blow molds. Moreover, high transportation costs are associated with very large containers.

In order to obtain a large storage volume with containers of this type, it is known, in the case of above-ground installation, that several smaller blow-molded containers can be arranged side by side and connected with one another by a filling line, an emptying line, and a venting line. Despite this interconnection of the individual containers, there is always the danger that the individual containers cannot be uniformly filled and uniformly or completely emptied. Containers stored underground must be designed in such a way that they are able to withstand the loads to which they are subjected by the weight of the soil and lifting forces due to groundwater.

SUMMARY OF THE INVENTION

Therefore, the goal of the invention is to develop a device for storing liquids, which, on the one hand, can be economocally manufactured by using inexpensive molds and, on the other hand, can also be inexpensively shipped from the manufacturing site to the storage site.

To achieve this goal with a device of the type described at the beginning, it is proposed, in accordance with the invention, that the container consist of at least two separately manufactured and largely identical container parts, each of which has an approximately rectangular cross section with an underside and an upper side, that it have a height that is considerably greater than the largest cross-sectional dimension, that each of the container parts have a lower and an upper flow socket on one side, and that the container parts be joined in the area of these flow sockets to form a single piece.

The individual container parts of the device for storing liquids can be manufactured inexpensively with production systems whose production or blowing volume is considerably smaller than the desired storage volume. The lines that were previously necessary between the individual container parts for filling, emptying, and venting the containers can be eliminated.

Additional features of a device in accordance with the invention are disclosed in the claims.

BRIEF DESCRIPTION OF THE DRAWINGS

The invention is explained in greater detail below with reference to an embodiment shown in the drawings.

DETAILED DESCRIPTION OF THE INVENTION

Figure 1:
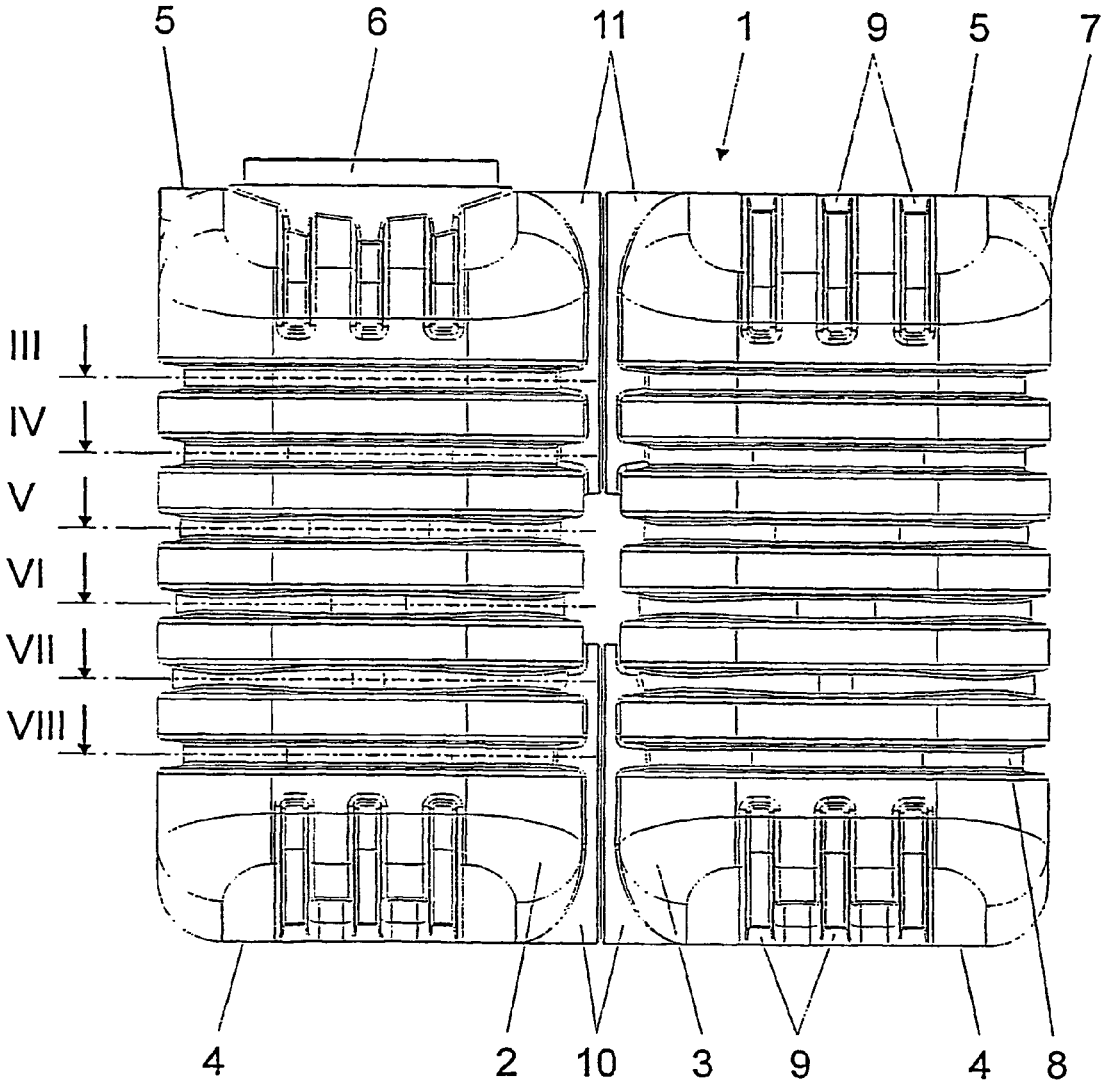
FIG. 1 shows a front view of a device in accordance with the invention.
Figure 2:
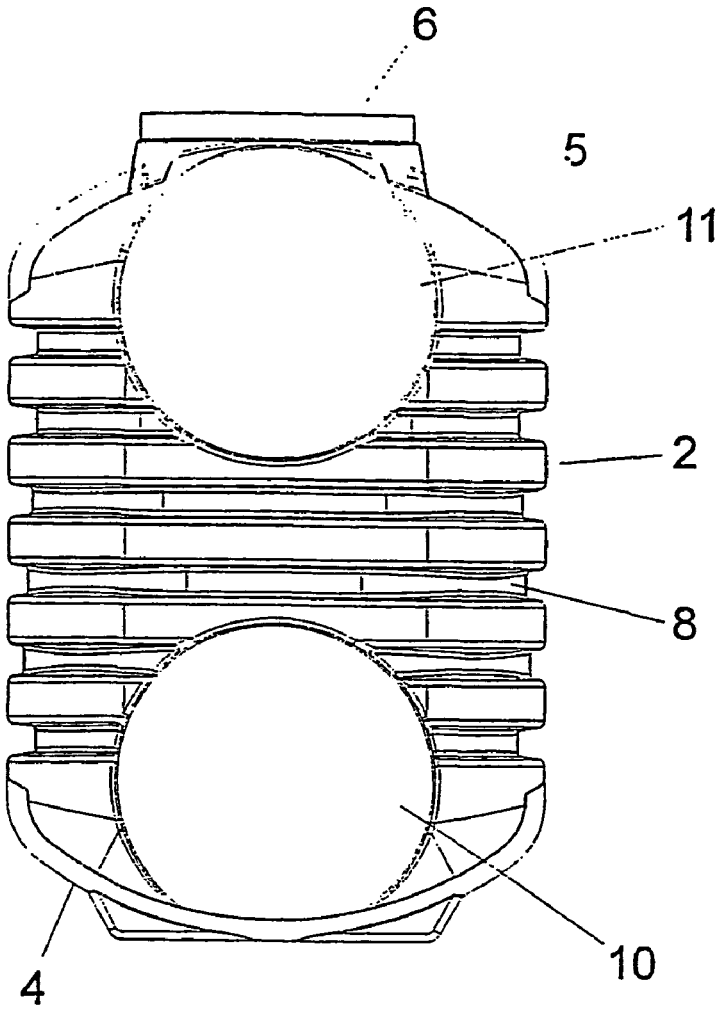
FIG. 2 shows a side view of a container element of FIG. 1.
Figure 3:
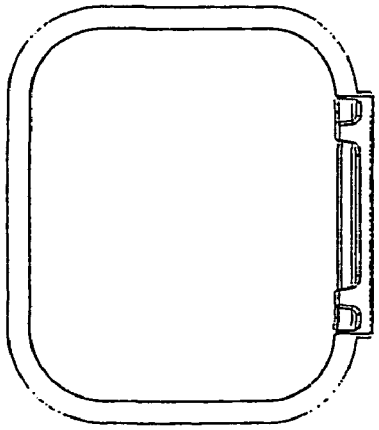
FIGS. 3 to 8 show horizontal sections through a container element of FIG. 1.
Figure 4:
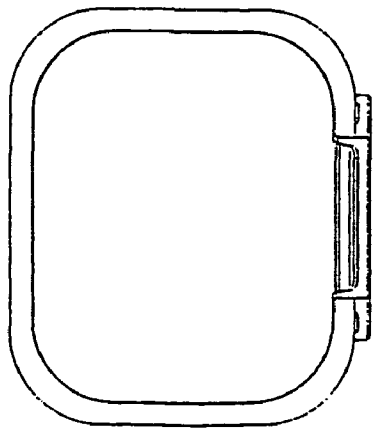
Figure 5:
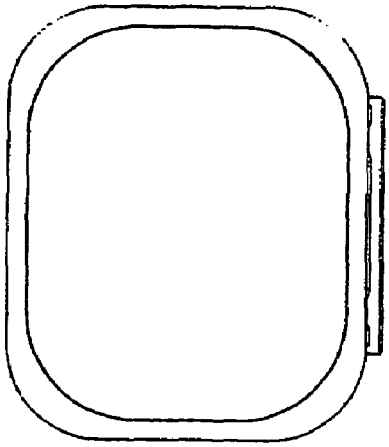
Figure 6:
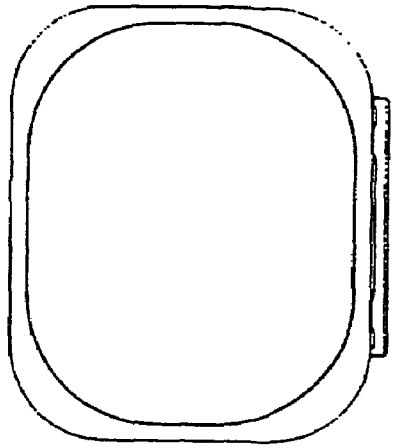
Figure 7:
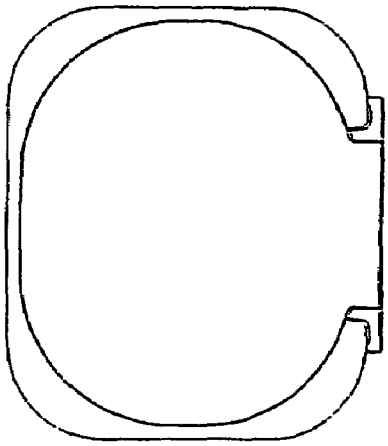
Figure 8:
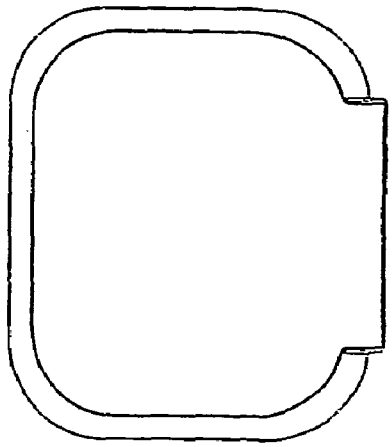
Figure 9:
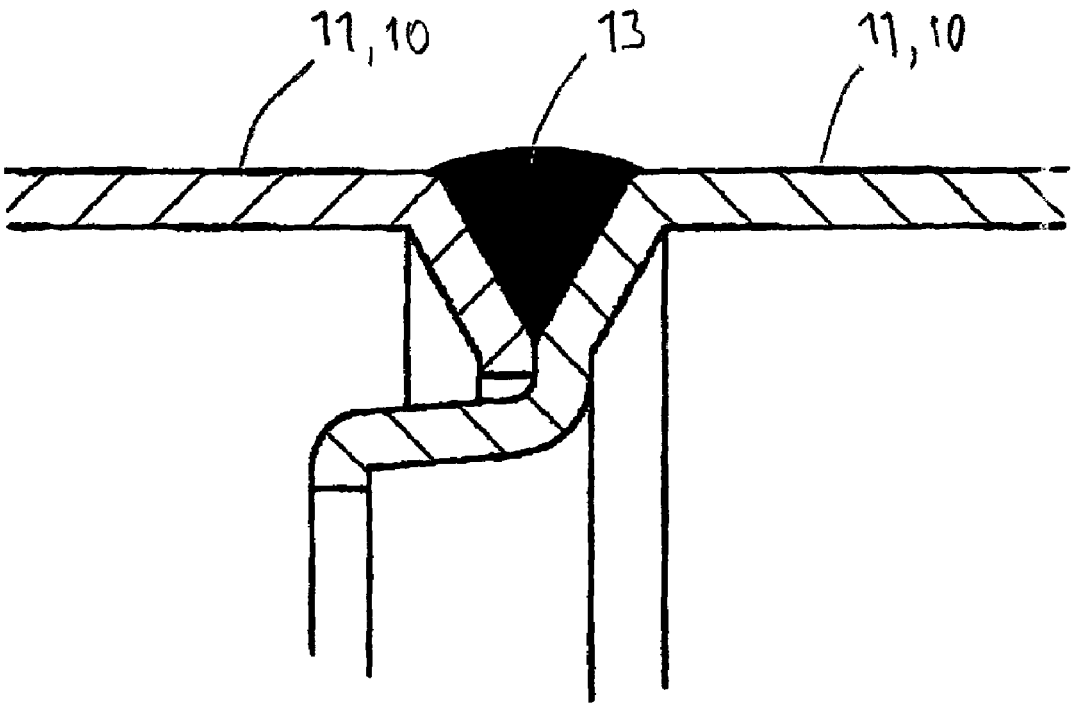
FIG. 9 shows the connection of two container parts.

FIG. 1 shows a device for storing liquids, which, in this embodiment, consists of a container 1 that is composed of two container parts 2, 3. Both container parts 2, 3 are made of plastic, for example, high-molecular-weight high-density polyethylene, and are produced by blow molding. They have an approximately rectangular cross section. Each container part 1, 2 has an underside 4 and an upper side 5 and, in the embodiment shown here, has a height that is about twice as great as the largest cross-sectional dimension. This means that the two container parts 2, 3 have an essentially rectangular-solid shape. The two container parts 2, 3 are advantageously produced in the same blow-molding mold; a different mold insert must be present only in the upper region of this mold. This is related to the fact that the upper region of container part 2 has a socket 6 with an opening, through which the container 1 can be filled and emptied.

In the middle section of both container parts 2, 3, stiffening corrugations 8 are molded in the wall 7. They run horizontally all the way around the wall and serve to reinforce it. The depth and cross section of these stiffening corrugations 8 may be uniform. However, it is advantageous and increases the stability of the container parts 2, 3, if the stiffening corrugations 8 have the cross-sectional shapes shown in FIGS. 3 to 8. The drawings show that the stiffening corrugations 8 increase in depth in the corner regions of the wall from below and from above, as FIGS. 4 to 7 show very clearly. The depth of the stiffening corrugations 8 is greatest in the end regions of the wall 7 in accordance with FIGS. 6 to 7.

To achieve further stabilization of the container parts 2, 3, stiffening corrugations 9, which run more or less perpendicularly to the longitudinal axis of the container parts 2, 3, are provided in the region of the underside 4 and the upper side 5. These stiffening corrugations 9 make it possible for the container to withstand the weight of the soil and the forces exerted by the groundwater. According to FIG. 1, the two container parts 2, 3 are designed exactly the same until just below the upper side 5. However, the upper side 5 of container part 2 is shaped differently from the upper side 5 of container 3, since the socket 6 with the opening is located there. This difference between the container parts 2, 3 can be realized relatively inexpensively by using different mold inserts in the upper region of the blowing mold, which is the same for both container parts 2, 3.

On one lateral face, each container part 2, 3 has two sockets 10, 11 spaced some distance apart one above the other, which bound a relatively large flow opening. The socket 10 is located in the lowermost region, and the socket 11 is located in the uppermost region of the container parts 2, 3. The two container parts 2, 3 are permanently joined at these sockets 10, 11 to form a one-piece container 1.

It is advantageous if one of the two sockets 10, 11 that are to be joined has a centering part, which is dimensioned in such a way that it can be guided into the opposing socket 10, 11. This facilitates the joining of the two container parts 2, 3.

The design described above makes it possible to produce several small container parts 2, 3 in an economical blow-molding mold, to ship them inexpensively, and to join them into a single container 1 on-site, e.g., in an excavated pit. In this regard, it is basically possible to join more than two container elements 2, 3. However, this requires that a container element be produced, which has sockets 10, 11 on two opposite walls 7, which can then be joined with the sockets 10, 11 of the container parts 2, 3. Although joining by fusion welding is advantageous, it is not absolutely necessary. Fusion welding makes it possible to arrange the container parts 2, 3 very close to each other, but, for example, with the use of connecting flanges on the sockets 10, 11, enough room must be available to allow mounting of the fastening screws.

What is claimed is:

1. Device for storing liquids, comprising a plastic container manufactured by a blowing process and having a single-layer or multilayer wall, and at least one filling and emptying hole, the container (1) further comprising at least two separately manufactured and largely identical container parts (2, 3), each of which has an approximately rectangular cross section with an underside (4) and an upper side (5), and a height that is considerably greater than the largest cross-sectional dimension, wherein each of the container parts has a lower and an upper flow socket (10, 11) on one side thereof, and wherein the container parts are joined in the area of the flow sockets (10, 11) to form a single piece.

2. Device in accordance with claim 1, wherein each container part has a wall (7) with a middle section, and wherein the middle section of the wall (7) of the container parts (2, 3) is provided with stiffening corrugations (8) that run all the way around the wall.

3. Device in accordance with claim 2, wherein the underside (4) and the upper side (5) have stiffening corrugations (9) that extend to the region of the wall (7).

4. Device in accordance with claim 3, wherein the stiffening corrugations (8, 9) have differenct depths and/or cross sections.

5. Device in accordance with claim 1, wherein the facing flow sockets (10, 11) of the two container parts (2, 3) have approximately the same cross section.

* * * * *